United States Patent [19]

Gerber

[11] 4,209,078

[45] Jun. 24, 1980

[54] ADJUSTABLE LADDER LEVELING DEVICE

[76] Inventor: Werner Gerber, Parry Sound Rd. N., Rosseau, Ontario, Canada, P0C 1J0

[21] Appl. No.: 929,216

[22] Filed: Jul. 31, 1978

[51] Int. Cl.[2] ..... E06C 7/44

[52] U.S. Cl. ..... 182/203; 182/204

[58] Field of Search ..... 182/204, 203, 201, 107, 182/108

[56] References Cited

U.S. PATENT DOCUMENTS

| | | | |
|---|---|---|---|
| 666,948 | 1/1901 | Weiss | 182/201 |
| 1,272,551 | 7/1918 | Smith | 182/203 |
| 1,462,505 | 7/1923 | Hunt | 182/201 |
| 2,213,471 | 9/1940 | Minnick | 182/201 |
| 2,517,771 | 8/1950 | DeStefano | 182/203 |
| 3,165,170 | 1/1965 | Blaney | 182/203 |
| 3,282,376 | 11/1966 | Merriman | 182/204 |
| 4,069,893 | 1/1978 | Blackstone | 182/204 |

*Primary Examiner*—Reinaldo P. Machado
*Attorney, Agent, or Firm*—Howard I. Podell

[57] ABSTRACT

A device attachable to the leg of a ladder to lengthen a leg that is too short to reach the uneven level of a supporting surface comprising a sleeve member clamped below the last and next-to-last rung of the ladder; an extension vertically adjustable in the sleeve; a threaded rod having a stop at its lower end abutting the top of the extension and a handle at its upper end for vertically displacing the extension; the lower end of the extension having pivoted thereon a plate with a skid-proof bottom.

3 Claims, 6 Drawing Figures

ADJUSTABLE LADDER LEVELING DEVICE

FIELD OF THE INVENTION

This invention relates generally to leveling means for metallic or wood ladders enabling the ladders to be positioned upright on inclined surfaces.

DESCRIPTION OF THE PRIOR ART

The prior art, as exemplified by U.S. Pat. Nos. 3,948,342; 3,964,574; 3,998,292; 4,029,174; 3,414,082; and 3,861,500 is generally illustrative of the pertinent art but the aforementioned patents are non-applicable to the present invention. While the prior art expedients are generally acceptable for their intended purposes only, they have not proven entirely satisfactory in that they are either complex and expensive to manufacture, or bulky and inconvenient to use, or to operate. As a result of the shortcomings of the prior art, typified by the above, there has developed a substantial need for improvement in this field.

The principal object of this invention is to provide a device or article of this character which combines simplicity, strength and durability in a high degree, together with inexpensiveness of construction owing to a minimum of parts so as to encourage widespread use thereof.

Additional objects and advantages of the invention will be set forth in part in the description which follows and in part will be obvious from the description, or may be realized by practice of the invention, the objects and advantages being realized and attained by means of the instrumentalities and combinations particularly pointed out in the appended claims.

SUMMARY OF THE INVENTION

This invention resides in a device attachable to the leg of a ladder without alteration of the ladder or use of special tools to lengthen a leg that is too short to reach the uneven level of a supporting surface comprising a sleeve member clamped below the last and next-to-last rung of the ladder; an extension vertically adjustable in the sleeve; a threaded rod having a stop at its lower end abutting the top of the extension and a handle at its upper end for vertically displacing the extension; the lower end of the extension having pivoted thereon a plate with a skid-proof bottom.

BRIEF DESCRIPTION OF THE DRAWING

In the accompanying drawing, in which is shown one of the various possible illustrative embodiments of this invention, wherein like reference character identify the same or like parts.

DESCRIPTION OF THE PREFERRED EMBODIMENTS

Figure 1:
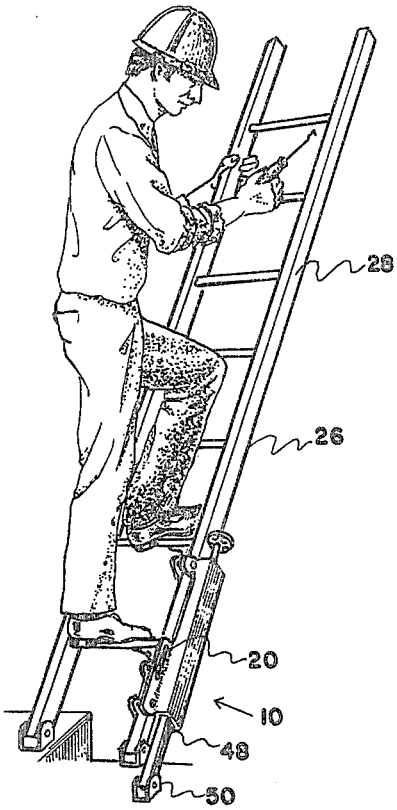
FIG. 1 is a perspective view showing use of a ladder equipped with the leveling device of the invention.
Figure 2:
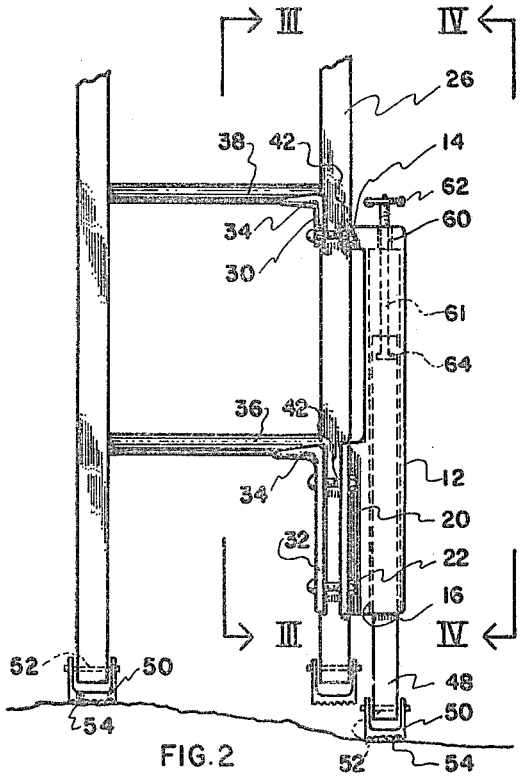
FIG. 2 is a front elevational view showing the lower end of the ladder and the leveling device.

With reference to the drawing, there is shown and illustrated a leveling device for ladders constructed in acordance with the principles of the invention and designated generally by reference character 10. The illustrated tangible embodiment of the invention includes an elongated metal sleeve 12 integral with spaced projecting securing plates 14, 16 on each side and having an open bottom 18. A pair of slots 20 and of holes 22 are provided on plate 16.

Figure 3:
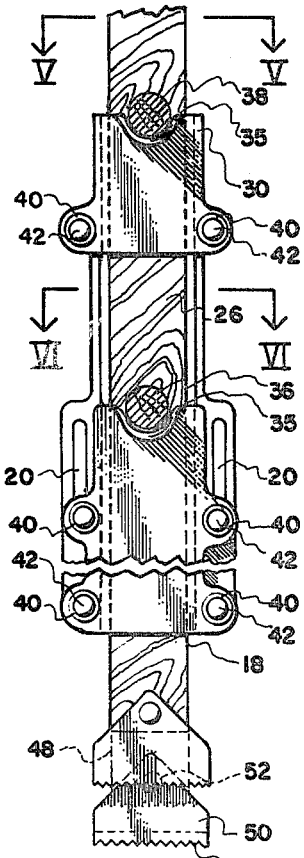
FIG. 3 is a cross-sectional view taken along line III—III of FIG. 2.

These two plates 14, 16 are adapted for attachment to leg 26 of ladder 28 by means of spaced brackets 30, 32. Each bracket includes a grooved longitudinal member 34 adapted to receive grooves 35 (FIG. 3) the ends of the last rung 36 and of the next-to-last rung 38 of ladder 28. The vertical portions of the brackets have on each side openings 40 through which pass bolts 42 secured on plates 14, 16 by nuts 44 on each side of leg 26.

A metal extension or leg 48 is slidably received in sleeve 12 and has a foot 50 pivoted by pin 52 to its lower end. Foot 50 has a skid-proof bottom formed, for example by rubber cleats or teeth 54.

Figure 4:
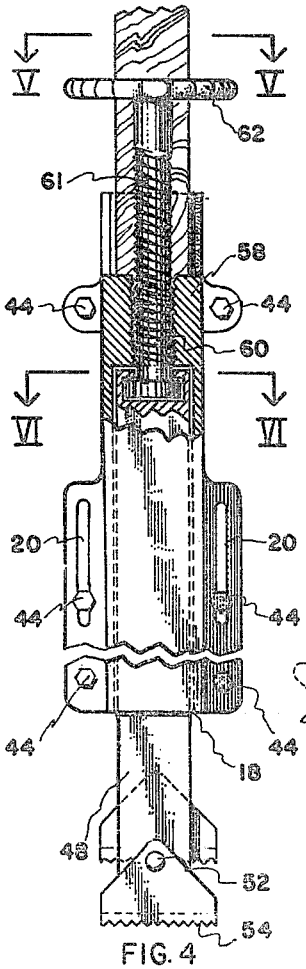
FIG. 4 is a cross-sectional view partly broken away taken along line IV—IV of FIG. 2.
Figure 5:
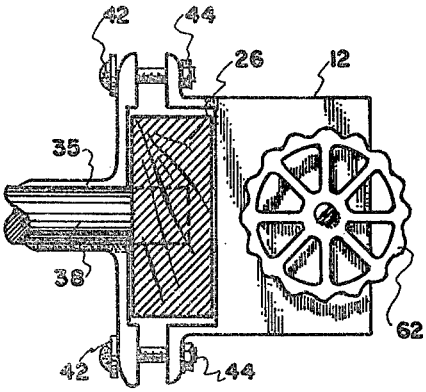
FIG. 5 is a cross-sectional view taken along line V—V of FIG. 4.
Figure 6:
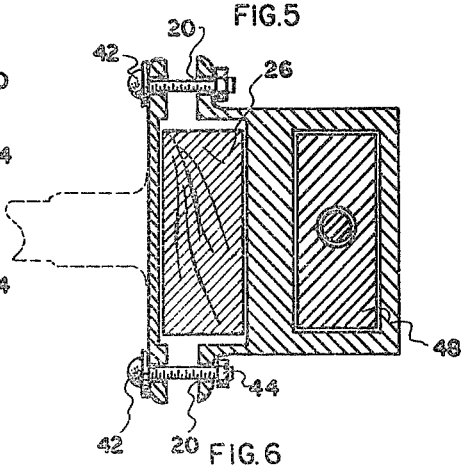
FIG. 6 is a cross-sectional view taken along line VI—VI of FIGS. 3 and 4.

The upper part of sleeve 12 (FIG. 4) has a solid portion 58 with a threaded vertical bore 60. A threaded rod 61 is movable in bore 60 and has a circular handle 62 integral with its top and a stop 64 at its lower end for adjusting the vertical position of extension 48.

The operation and use of the invention hereinabove described will be evident to those skilled in the art to which it relates from a consideration of the foregoing.

The present invention is believed to accomplished among others all of the objects and advantages herein set forth.

Without further analyses, the foregoing will so fully reveal the gist of this invention that those skilled in the art can by applying current knowledge thereto readily adapt it for various applications without omitting certain features which can constitute essential characteristics of the generic or specific aspects of this invention. Therefore, a more lengthy description is deemed unneccessary.

It is intended that various changes may be made in this invention in the practical development thereof, if desired. Such changes are comprehended within the meaning and range of equivalency of the following claims. The invention, therefore, is not to be restricted except as is necessitated by the prior art.

Having thus described the invention, what is claimed as new and to be secured by Letters Patent is:

1. An adjustable ladder device attachable to a lower portion of a leg to lengthen said leg so that the ladder may be supported on an inclinded surface, comprising a vertical sleeve, a vertical extension vertically movable in said sleeve and fitted at its lower end with support means, adjusting means extending from said sleeve, which adjusting means engage said extension for regulating the vertical displacement of the lower end of said extension below said sleeve, with said sleeve fitted with a pair of spaced upper and lower securing plates, together with a bracket that is bolted to each said plate such that a section of the lower portion of a ladder leg may be clamped between the plates of said sleeve and each of said brackets, with each bracket formed with a horizontal portion having a groove for receiving a portion of a rung of an attached ladder, together with means to adjust the spacing between said brackets, so that the horizontal portion of each bracket may bear against an individual rung of an attached ladder, when the device is clamped about a ladder leg.

2. The combination as recited in claim 1 in which the said adjusting means extends through a top portion of said sleeve.

3. The invention as recited in claim 2, wherein said adjusting means comprises a threaded rod that is treadably engaged to said sleeve and having an actuating handle means fixed to its upper end.

* * * * *